US005599261A

United States Patent [19]

Easley et al.

[11] Patent Number: 5,599,261

[45] Date of Patent: Feb. 4, 1997

[54] EXERCISE DEVICE WITH TWO-WAY ARTICULATION

[75] Inventors: James B. Easley, Minneapolis; Thomas G. Tupper, Eden Prairie, both of Minn.

[73] Assignee: Fitness Master, Inc., Waconia, Minn.

[21] Appl. No.: 566,937

[22] Filed: Dec. 4, 1995

[51] Int. Cl.[6] ..... A63B 21/04

[52] U.S. Cl. ..... 482/130; 482/140; 482/137

[58] Field of Search ..... 482/129, 130, 482/133, 134, 135, 136, 137, 95, 96, 140

[56] References Cited

U.S. PATENT DOCUMENTS 5,256,126 10/1993 Grotstein ..... 482/130
5,277,684 1/1994 Harris ..... 482/130

OTHER PUBLICATIONS

Informational brochure from Soloflex, Inc, for rockit(™), copyright 1995.

*Primary Examiner*—Lynne A. Reichard
*Attorney, Agent, or Firm*—Dorsey & Whitney LLP

[57] ABSTRACT

The present invention provides an exercise device for exercising at least two groups of muscles. The device includes a first subframe supporting body support members including a foot rest and seat. A second subframe is operably coupled to the first subframe by a joint having two axes of rotation and internal stops for controlling the rotation about both axes. A back rest is carried by the second subframe. The back rest is movable in generally opposite directions to exercise the two groups of muscles. Elastomeric resistance elements are selectively and operably coupled across the joint.

5 Claims, 8 Drawing Sheets

20
98
94
82
92
96
90
84
24
70
26
152
78
80
40
34
36
42
22
130
102
76
32
86
74
38
28
30
44
59

EXERCISE DEVICE WITH TWO-WAY ARTICULATION

TECHNICAL FIELD

The present invention relates to exercise devices. More particularly, it relates to an exercise device for performing at least two exercises. The device includes a single articulation or joint having two separate axes of rotation and internal stops whereby a portion of the device can be moved in two directions.

BACKGROUND OF THE INVENTION

Years ago, everyday tasks and normal activity provided sufficient exercise for most people. With the advent of automation and a more sedentary, administrative lifestyle came the need for people to engage in exercise for reasons of enjoyment and health. Jogging or running is popular, but the associated impact may be harmful to joints. Exercise machines or devices, including stationary bicycles, treadmills, skiers and the like became, and remain, popular for providing a low impact, indoor exercise. Many of these machines, particularly those developed early, are complicated, cumbersome and impossible to move from a position of use to a storage location. Another problem is ha he machines typically provide one exercise or affect a single group of muscles. There are some machines, e.g., skiers, bench-type machines or treadmills, that attempt to provide more than one exercise, but such machines are typically large and require separate mechanisms for each exercise or group of muscles to be exercised.

It would be advantageous if there were a simple compact, portable exercise device ergonomically designed to provide low impact exercise for at least two different muscle groups.

SUMMARY OF THE INVENTION

The present invention provides an exercise device for exercising at least two groups of muscles. The device comprises a frame and body support members coupled to the frame, wherein at least one of the body support members is movably coupled to the device through a joint. The frame includes first and second subframes, the first subframe supporting body support members including a foot rest and seat. The second subframe is operably coupled to the first subframe by the joint, which has two axes of rotation and internal stops for controlling the rotation about both axes. A back rest is carried by the second subframe. The back rest is movable in generally opposite directions to exercise the two groups of muscles. Elastomeric resistance elements are selectively and operably coupled across the joint.

More specifically, the device of the present invention comprises a frame including a generally tubular, arcuate base subframe having two ends, which contact or are adjacent to a generally horizontal support surface (a floor or the like) on which the device is resting. The base subframe includes an uppermost location farthest from the support surface between the ends. A movable subframe is operably coupled to the base subframe adjacent to the uppermost location and is movable in two generally opposite and arcuate motions or directions. A double joint, providing two separate, generally parallel axes of rotation, joins the base and movable subframes. The joint includes a movable link arm with two ends, one of the axes of rotation at each end of the arm. A foot rest member, angled slightly with respect to the support surface, is carried by the base subframe adjacent to one of the ends of the base subframe. A seat member is carried by the base subframe generally between the uppermost location and the foot rest, at a level, with respect to the floor, above the level of the foot rest. A back rest is carried by the movable subframe. A curved handlebar yoke is attached to the back rest, and ends in hand grips. Elastomeric tension members are selectively and operably coupled across the joint.

The foot rest, seat and back rest are ergonomically shaped and positioned in accordance with ergonomic data drawn from the publication entitled *Human Scale*, by Diffrient, N., Tilley, A and Harmon, D., MIT Press. The data was used to ensure that the device of the present invention would provide an ergonomically correct motion targeting specific muscle groups and be comfortable for a wide range of users. The body support members (foot rest, seat and back rest) accommodate an exerciser in a sitting position with the exerciser's feet contacting the foot rest member, the exerciser's buttocks contacting the seat member and the exerciser's back generally contacting and resting against at least a portion of the back rest and support member. This position is a neutral or rest position.

In use, the device may be used to exercise at least two groups of muscles: a group of abdominal muscles and a group including the lower back, gluteus and quadriceps muscles. For the abdominal exercise, a user sits in the device, grips the hand grips and bends forward at the waist, tending to move the top of the movable subframe and back rest toward the foot rest, thereby "crunching" the abdominal muscles. For exercising the back, gluteus and quadricep muscles, the user holds the hand grips and simultaneously uses the back, gluteus and quadricep muscles, flexing them and pushing against the foot rest and back rest, tending to move the top of the movable subframe and back rest away from the foot rest, thereby raising the buttocks from the seat, arcing or arching the body. In either instance, the user stars from and returns to the generally central, neutral, sitting position, and the movements may be done repetitively until the desired level of workout is achieved.

It is an object of the present invention to provide a safe, effective exercise device for exercising at least two different groups of muscles, wherein the device is ergonomically designed to be used comfortably and effectively by most people. The ergonomic design includes a selected positional relationship among the foot rest, seat and back rest, as well as the range of motion between the internal stops and the length of-the linking arm of the joint and the location of the pivot points or axes of rotation with respect to the user.

It is another object of the present invention to provide for a safe, effective aerobic, cardiorespiratory workout, as well as for anaerobic muscle building, while minimizing strain on a user's joints.

A feature of the exercise device of the present invention is a joint with internal stops, inaccessible when the joint is assembled. The stops provide for a "soft" stop, i.e., a gradual slowing and stop, at the limit of exercise motion, and eliminate external pinch points. This is accomplished by providing two hubs each having a pair of generally arcuate slot openings adjacent to and around an axis of rotation. The hubs are connected by a substantially hollow movable linking arm with stop posts. The arm, and posts, are formed by two complementary half links. An advantage of the joint is that it provides for exercise motion in two different initial directions. Each direction has its own pivot point or hub and separate resistance.

Another advantage of the device of the present invention is that it is compact and easily portable, yet provides for at least two separate exercises and folds to an even more compact storage configuration wherein the back rest is folded down to lie closely adjacent to the seat and foot rest.

Another object of the present invention is to provide a multi-purpose exercise machine for providing low to high resistance training including the performance of "ab-curls" for toning abdominal muscles and "leg presses" for strengthening and toning the legs and back.

These and other objects, features and advantages of the present invention will become more apparent with reference to the drawings, the description of the preferred embodiment and the appended claims.

DETAILED DESCRIPTION OF THE PREFERRED EMBODIMENT

The Figs. depict the exercise device 20 of the present invention and features and components thereof. Although the preferred embodiment of the device 20 is intended primarily for use in performing ab-curls or ab-crunches to exercise the abdominal muscles of a user and leg presses starting from a seated position to exercise the legs and back muscles, the device 20, and particularly the joint thereof, could be adapted for performing other exercises by, for example, repositioning the joint. One such other exercise is bent knee situps.

With regard to means for fastening, mounting, attaching or connecting the components of the present invention to form the exercise device 20 as a whole, unless specifically described as otherwise, such means are intended to encompass conventional fasteners such as machine screws, rivets, nuts and bolts, toggles, pins, or the like. Other fastening or attachment means appropriate for connecting components include adhesives, welding (e.g., frame members) and soldering, the latter particularly with regard to electrical connections required for electrical or electromechanical monitoring equipment (not shown) associated with the device 20. Unless specifically otherwise disclosed or taught, materials for making the components of the present invention are selected from appropriate materials such as aluminum, steel, metallic alloys, various plastics and vinyls, plexiglass, fiberglass or the like.

Figures 1, 10:
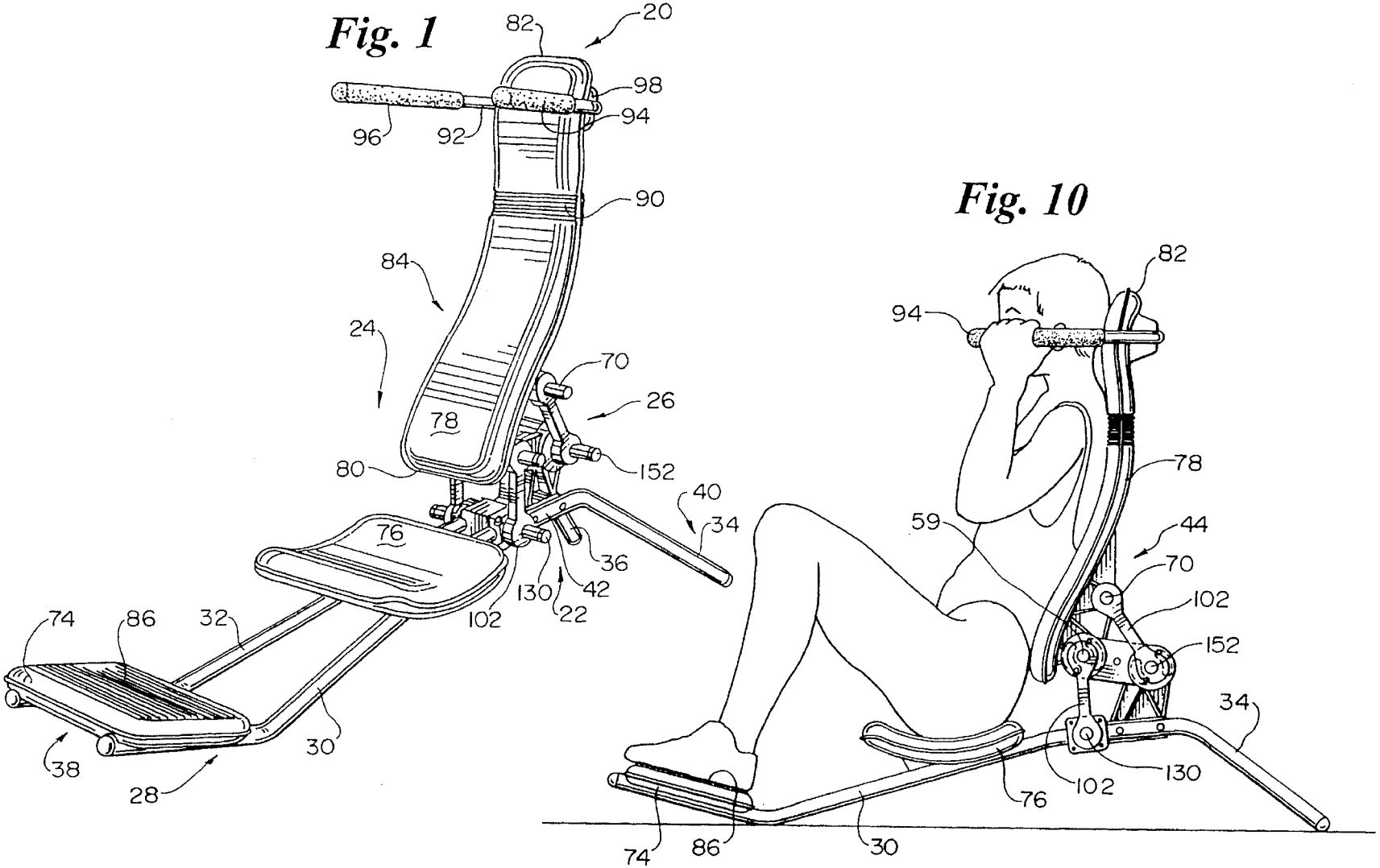
FIG. 1 is a perspective view of the exercise device of the present invention, depicting it in a static, rest position ready for use.
FIG. 10 is a left side elevational view of the exercise device of the present invention depicting a person ready to use the machine, the person being depicted in the generally central, neutral rest position.

In the following description, any references to right and left, top and bottom, upper and lower and horizontal and vertical are to be read and understood with their conventional meanings and with reference to viewing embodiments of the exercise machine 20 of the present invention as depicted in FIG. 1, an isometric view of one embodiment, and FIG. 2, an elevational view of the same embodiment, depicting a person ready to use the machine 20. The terms joint, articulate and articulation are intended to mean a movable connective hinge, joint or coupling between two rigid or semi-rigid parts, and the state of being joined, coupled or connected movably. The terms joint, articulate and articulation are also intended to encompass a three-link, two degree of freedom, grounded open chain linkage, i.e., the preferred embodiment of the joint of the present invention.

Referring then to the Figures, particularly FIG. 1, the exercise machine 20 of the present invention includes a frame 22, body support members 24 and a connective double joint 26.

Figure 4:
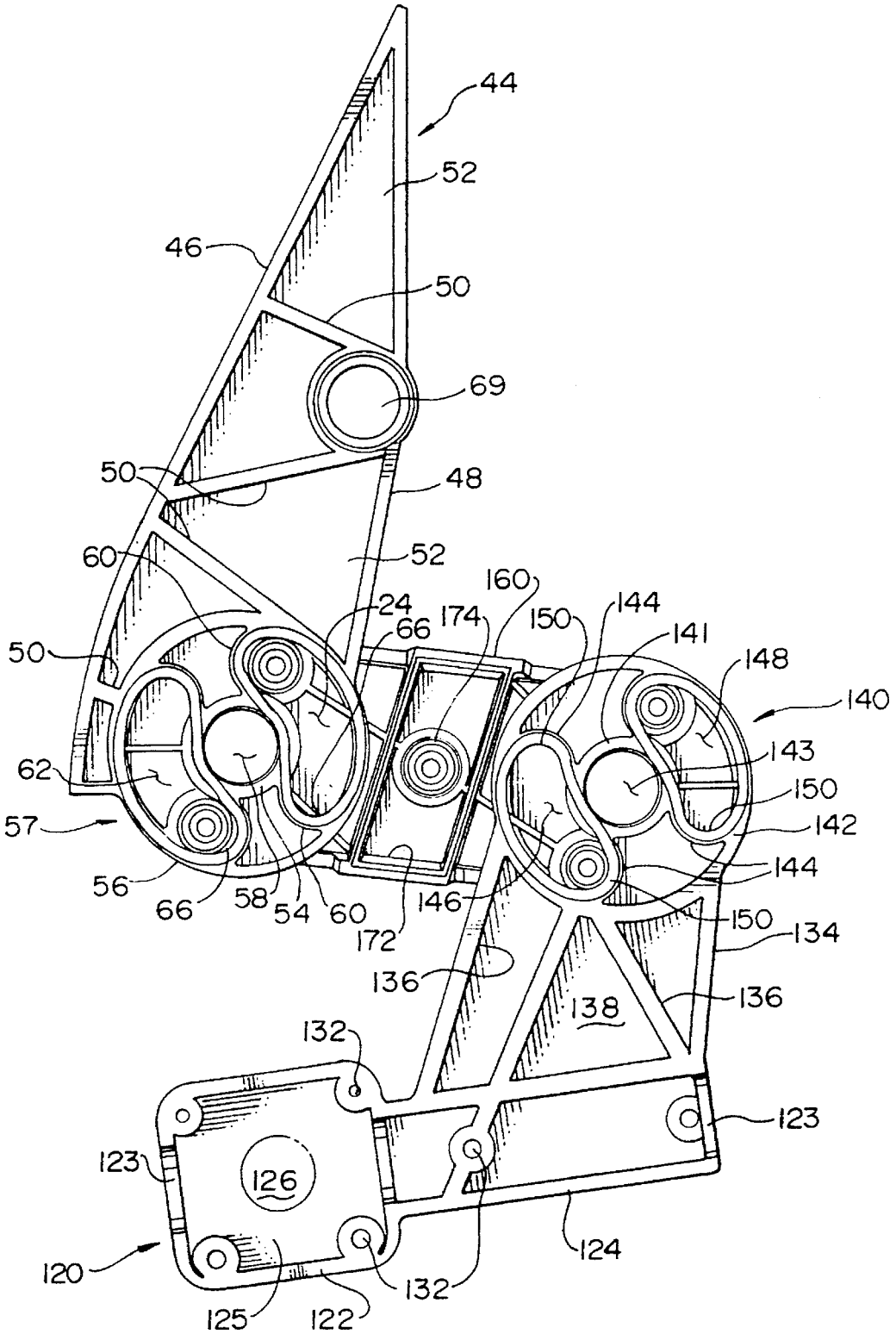
FIG. 4 is a left side elevational view of the two-way articulated joint, with portions of the joint removed.

The frame 22 includes a generally arcuate floor-contacting subframe 28 formed by two generally tubular rails, in turn forming two substantially similar, mirror image tubular front legs 30, 32 and two substantially similar, mirror image tubular rear legs 34, 36. The subframe 28 includes a first end indicated generally at 38 and a second end indicated generally at 40. Between the ends it includes an uppermost location 42. The frame 22 also includes a second subframe 44, best seen in FIGS. 2, 4 and 10. The second subframe 44 is movable with respect to the first subframe 28 and, referring to FIG. 4, includes a back rest mounting plate 46, an integral support structure comprising a span 48 and a plurality gussets (all indicated at 50). A substantially continuous web 52 extends between the plate 46 and span 48, and among the gussets 50. At one end, the second subframe member 44 includes concentric circular flanges 54, 56 forming a hub structure 57. The inner flange 54 defines a mounting hole 58 for receiving a tubular cross pin axle 59. A tubular axle 59 is preferred, but a solid axle (not shown) could be used. The outer flange 54 and internal gussets 60 between the flanges 54, 56 define a pair of generally arcuate, kidney-shaped stop receiving openings 62, 64. The ends 66, 68 of each opening 62, 64 are rounded and slightly tapered.

Figure 2:
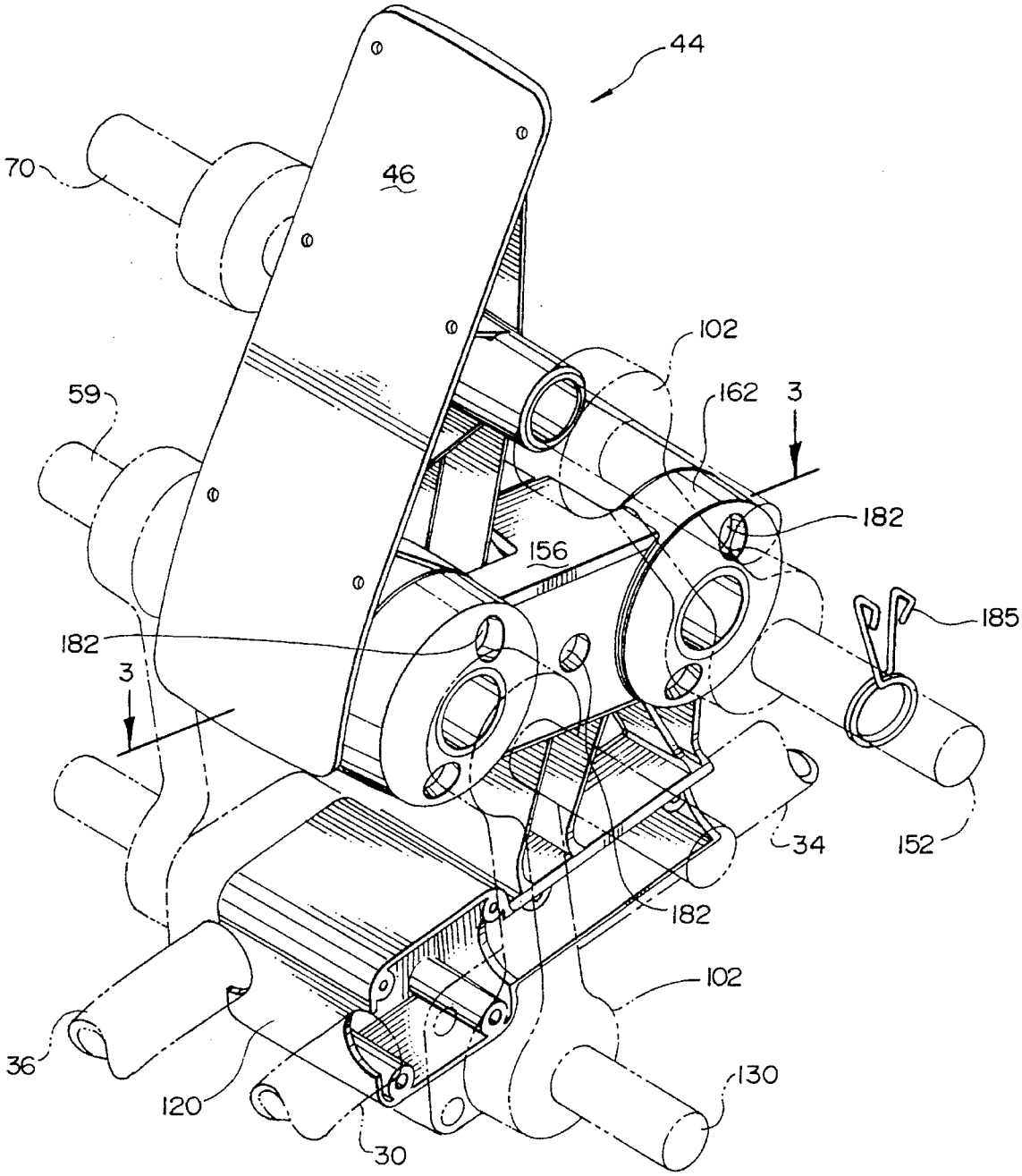
FIG. 2 is an enlarged, fragmentary perspective view of the two-way articulated joint of the exercise device of the present invention, with portions of the joint and exercise device removed and depicted in phantom.

The movable subframe 44 also includes an upper crosspin mounting hole 69 spaced from the first mounting hole 58 for receiving a back cross pin 70 (FIGS. 1 and 2).

The body support members, indicated generally at 24 in FIG. 1, include a foot rest 74, a seat 76 and a back rest 78. The foot rest 74 is adjacent to one end 38 of the base subframe 28 and the seat 76 is located between the uppermost region 42 of the subframe and the foot rest 74. Referring to FIG. 10, the seat 76 is generally above the foot rest 74. The back rest 78 includes a tail end 80 generally adjacent to the seat 76 and an uppermost head end 82. Between the tail end 80 and the head end 82, the backrest 78 includes a substantially continuous curved central portion 84 designed to accommodate and match the natural contour of the human spine from the lumbar to the cervical region. The foot rest 74 includes a textured upper portion 86. The texture may be provided by a plurality of parallel raised regions or treads as shown in FIGS. 1 and 10, or other texturing means, such as raised islands or scallops, can be used. Similarly, the central portion 84 of the back rest 78 includes a textured region 90 at about the shoulder blade area of a user (as depicted in FIG. 10). A continuous curved handle bar 92 is provided adjacent to the uppermost head end 82 of the back rest 78. The handlebar 92 is generally U-shaped and terminates at two padded hand grips 94, 96. A mounting block 98, which may be integrated with the handlebar 92 or the back rest 78, is provided to connect the handlebar 92 to the back rest 78.

Figure 8:
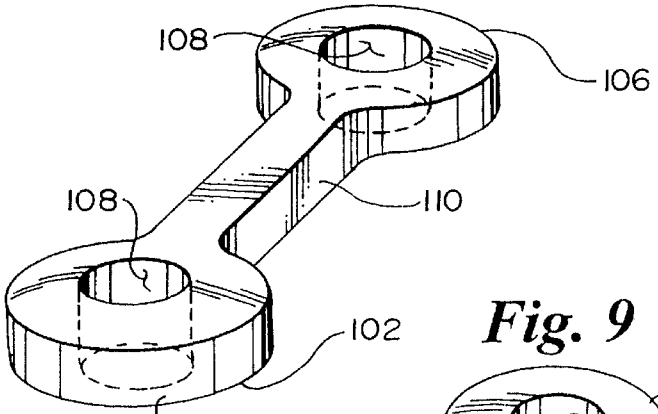
FIG. 8 is a perspective view depicting one embodiment of one of the elastomeric resistance elements of the exercise device of the present invention.
Figure 9:
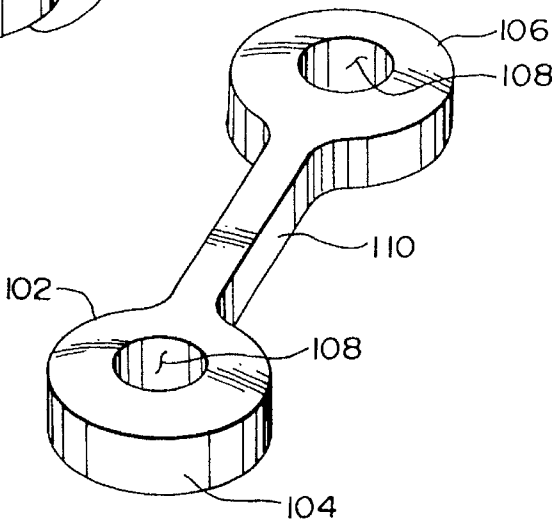
FIG. 9 is a perspective view depicting another embodiment of one of the elastomeric resistance elements.

Referring to FIGS. 8 and 9, the exercise device 20 of the present invention includes elastomeric, band-like tension members 102 for placement at the pivot points of the joint 26 as depicted in FIG. 1. The tension members 102 are generally bone-shaped, including two ends 104, 106, each end with a receiving hole 108. The ends 104, 106 are connected by a continuous shaft 110. The elastomeric members 102 are available in at least two different sizes or weights to provide at least two levels of resistance. This is depicted by the apparent difference between the members 102 shown in FIGS. 8 and 9.

Referring to FIGS. 2–7, the joint 26 includes a base 120. The base 120 includes a pin terminal 122 and an elongated bridge 124 integrally connected to the pin terminal 122, both of which are provided with rail nests 123. The pin terminal 122 includes a central web 125 with an aperture 126 for receiving a base cross pin 130 (shown in FIG. 2). The pin terminal 122 also includes a plurality of clamping bolt holes 132 whereby the front and rear leg members of the base frame may be coupled to the base 120 in the rail nests 123. The base 120 includes a generally upright standard 134 formed by a plurality of gussets 136 and webs 138. The standard 134 terminates in an uppermost concentric circular flange hub structure 140, including concentric circular flanges 141, 142. The inner flange 141 defines a mounting hole 143. The outer flange 142 and internal gussets 144 between the flanges 141, 142 define a pair of generally arcuate, kidney-shaped stop receiving openings 146, 148. The stop ends 150 of each opening 146, 148 are rounded and slightly tapered. The mounting hole 143 is for receiving a second tubular cross pin axle 152 (seen in FIGS. 2 and 3).

Figure 3:
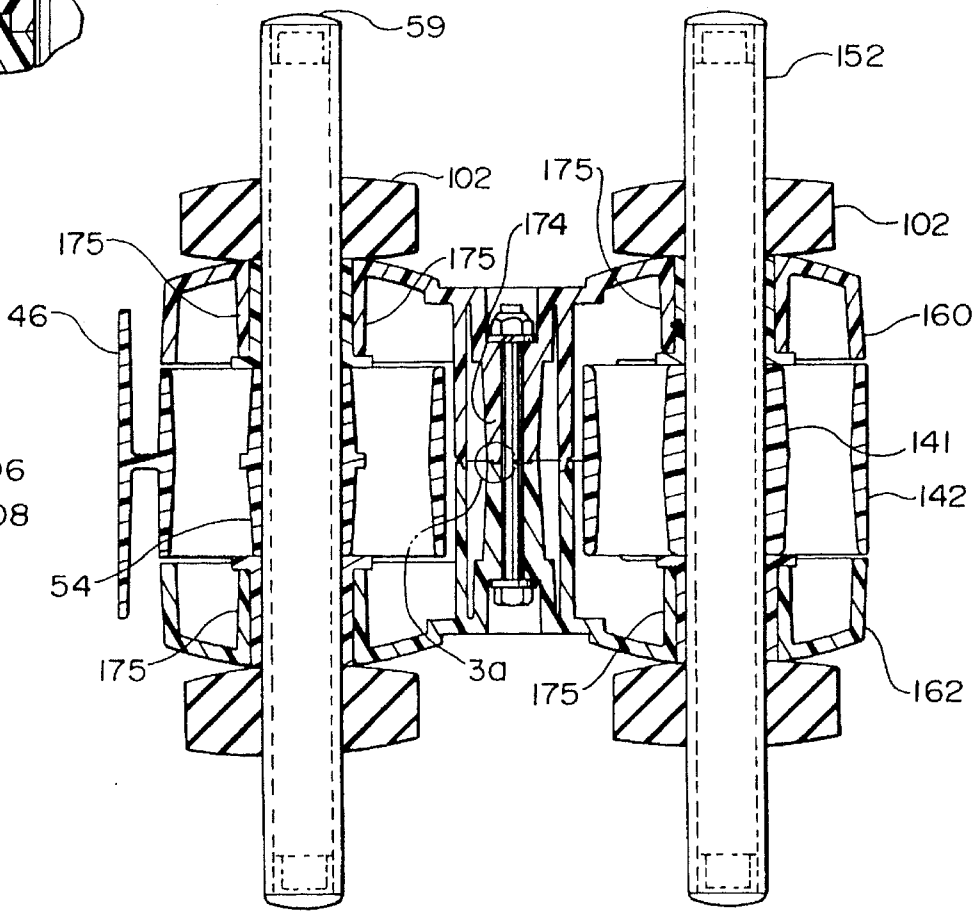
FIG. 3 is a sectional plan view taken along line 3—3 of FIG. 2.
Figure 3A:
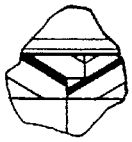
FIG. 3*a* is a enlarged detailed view of the area circled at 3*a* in FIG. 3.
Figure 5:
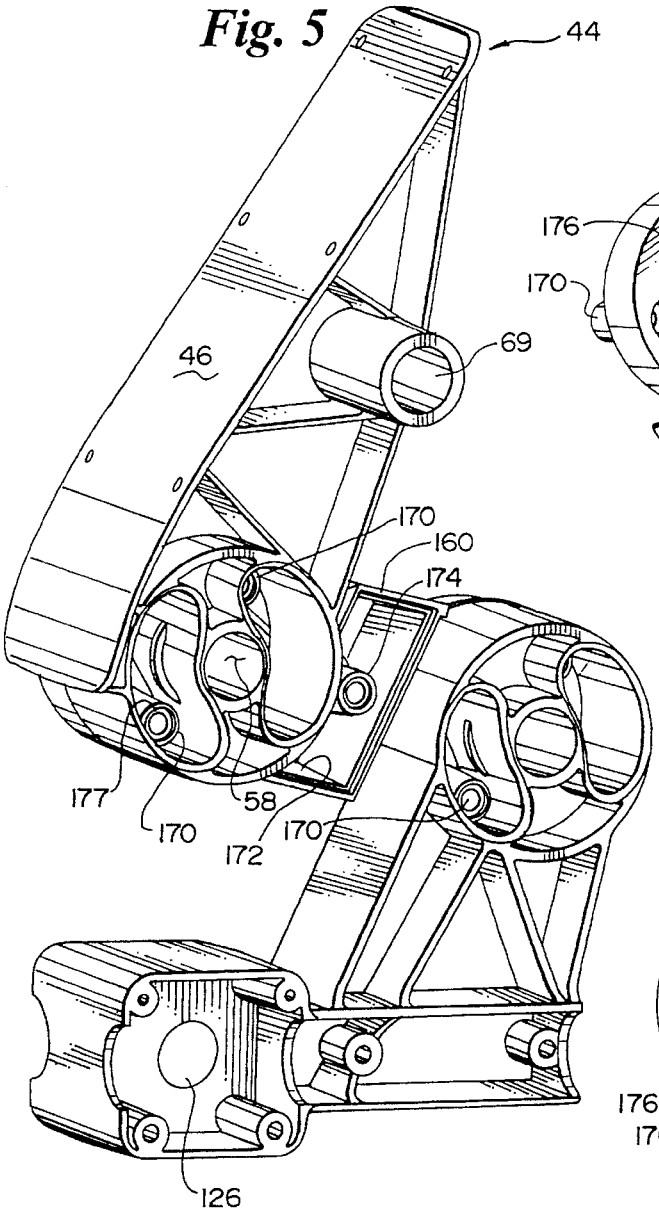
FIG. 5 is a perspective view of the joint, and is similar to the view of FIG. 4.
Figure 6:
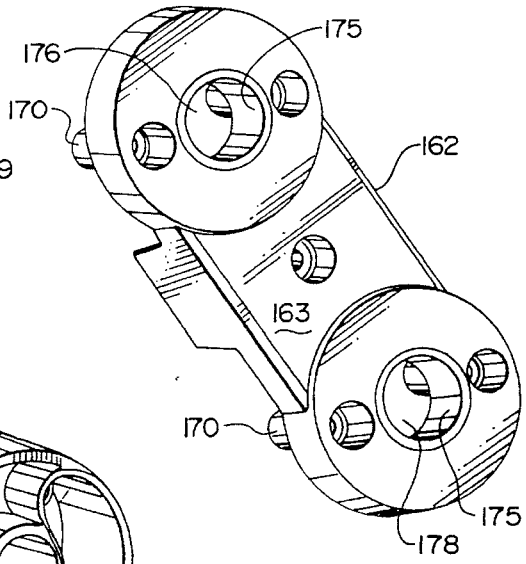
FIG. 6 is an oblique, left side perspective view of the left side link element of the joint of the present invention.
Figure 7:
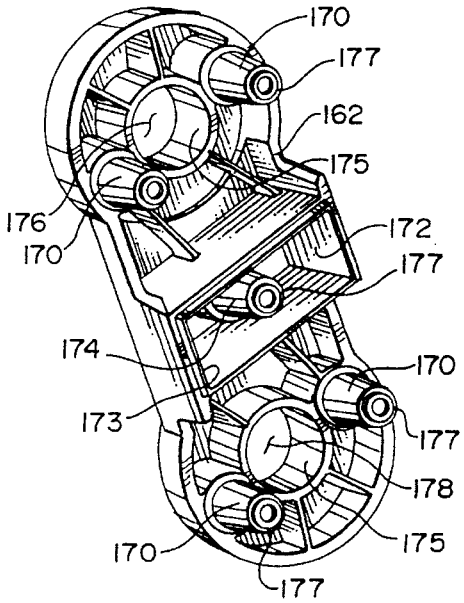
FIG. 7 is a view of the link element depicted in FIG. 6 rotated 180° about its longitudinal axis to show the opposite side thereof.

The joint 26 further includes a generally hollow link arm 156 (FIG. 2) formed by a pair of mating link half members, a right half link member 160 and a left half link member 162. The link halves 160, 162 have a substantially continuous, smooth exterior surface 163, as exhibited by the left link half 162 shown in FIG. 6 and a gusseted, honeycomb interior structure as shown in FIG. 7. Each link half 160, 162 includes four internal stop half posts 170, a central box structure 172 and blind half post 174. Each link half 160, 162 includes a circular interior flange 175 adjacent each end. When the arm 156 is assembled, the flanges 175 of both half links 160, 162 cooperatively define openings 176, 178. Opening 176 is for being aligned with the hole 58 and receiving the axle 59, and opening 178 is aligned with the hole 143 of the standard 134 to receive the other axle 152. It should be appreciated that the link halves 160, 162 are substantially mirror images, although they have complementary stepped edges. Specifically, as shown in FIG. 7, the edges 173 of the box structure 172 and the facing, innermost edges 177 of the stop half posts 170 and blind half post 174 of the left link half 162 are stepped or kerfed to form a step. As seen in FIG. 5, the mating edges of the right half link 160 are stepped complementarily the opposite way. The mated stepped edges of the link halves 160, 162, particularly of the blind post 174, are depicted in FIG. 3*a*. When the link halves 160, 162 are assembled, as shown in FIG. 2, bolts 182 are passed entirely through the joined stop and blind half posts 170, 174, respectively, to secure them together. The joined stop half posts 170 are within the stop receiving openings 62, 64 and 146, 148 and, cooperatively therewith, form the internal stops of the present invention. As shown in FIG. 3, suitable bearings 149 or other suitable low friction material may be lodged at the holes for receiving the axles 59, 152 and, although not shown, in the holes 108 of the elastomeric members 102 as well. Spring clips 185 (one is depicted in FIG. 2) may be used to hold the elastomeric members 102 in place on the joint 26, i.e., on the extending ends of the cross pins 130, 70 and axles 59, 152.

It should be appreciated that the joint 26 of the present invention comprises the base 120 and the subframe member 44, specifically the hub portions thereof, joined by the arm 156 formed by the right and left half links 160, 162. The box structure, stop and blind posts, stepped edges of the arm 156 and the through bolts holding the half links 160, 162 together provide that the arm 156 is strong and rigid.

Figure 15:
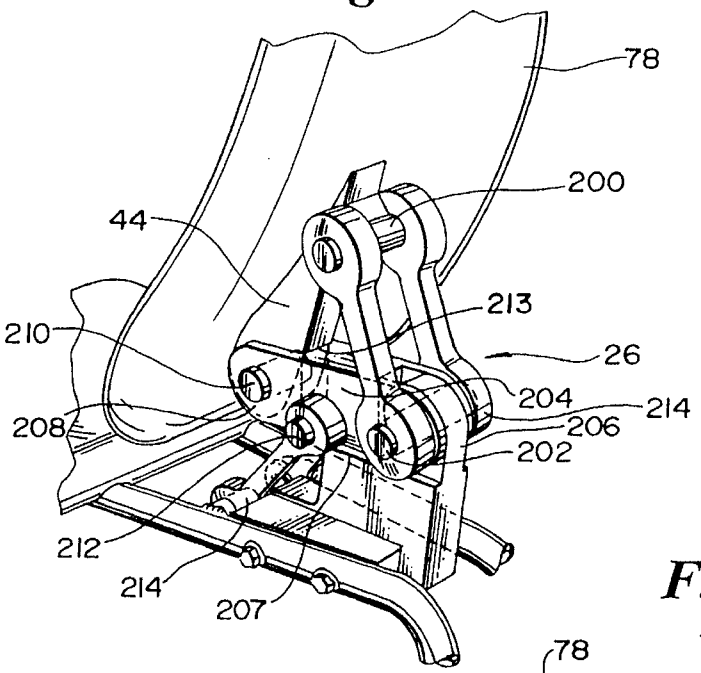
FIG. 15 is a fragmentary perspective depicting an alternative embodiment of the joint of the exercise device of the present invention.

FIG. 15 depicts an alternative embodiment of the joint 26 of the present invention wherein the movable subframe 44 carries a cross pin terminal 200. A first axle 202 is received at one end of an arm 204 and at the standard 206 which has an upper, flat stop surface 207. The second, free end 208 of the arm 204 carries a second axle 210. The arm 204 also carries a mid-link pin 212, and has a external stop edge 213. Elastomeric members 214 (similar to the member 102) are mounted on the ends of the pins to provide resistance to movement.

Figure 11:
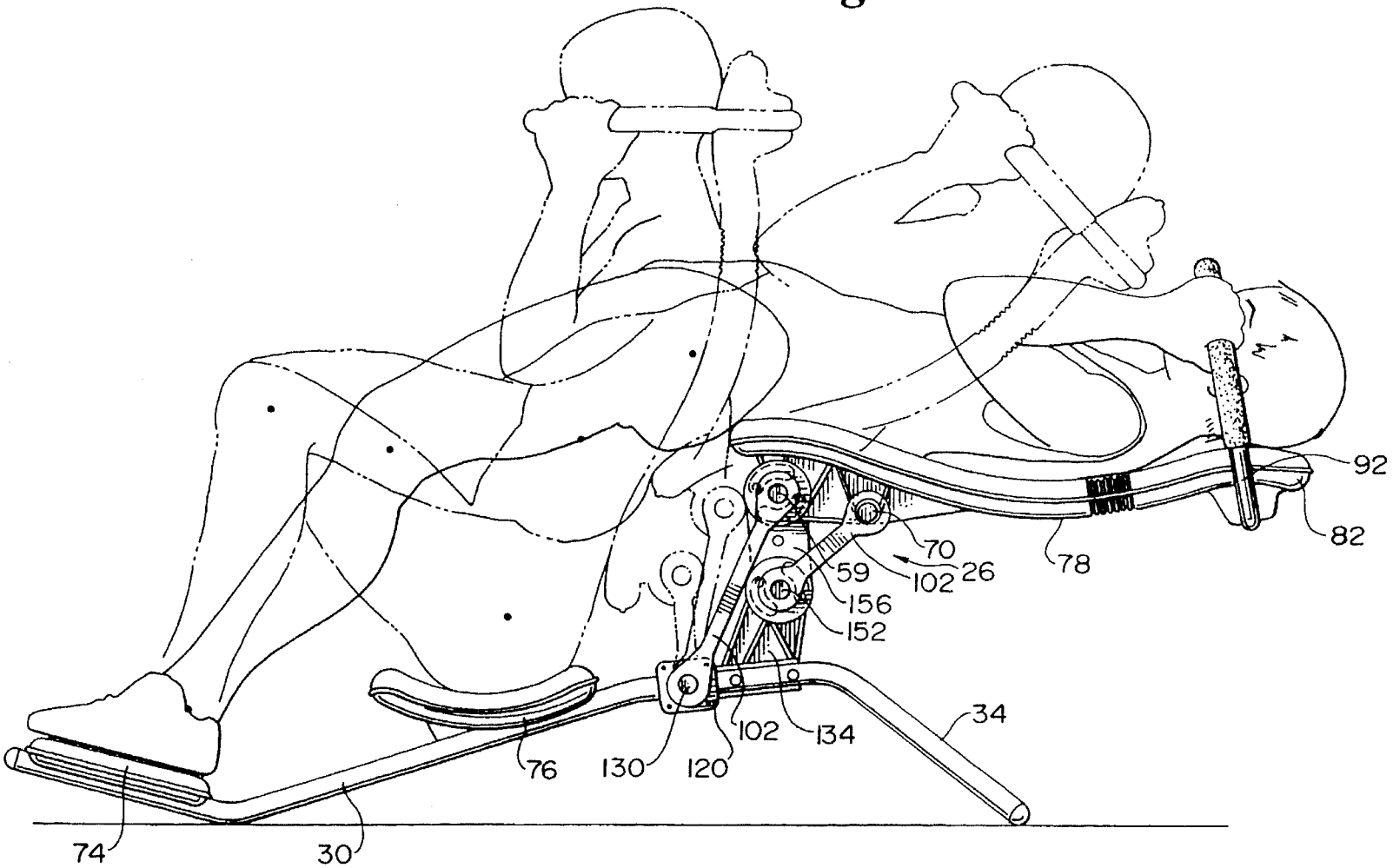
FIG. 11 is a left side elevational view of the present invention illustrating the mechanical and biomechanical function of extension and physical exercise, with the neutral and intermediate positions depicted in phantom dashed line.
Figure 12:
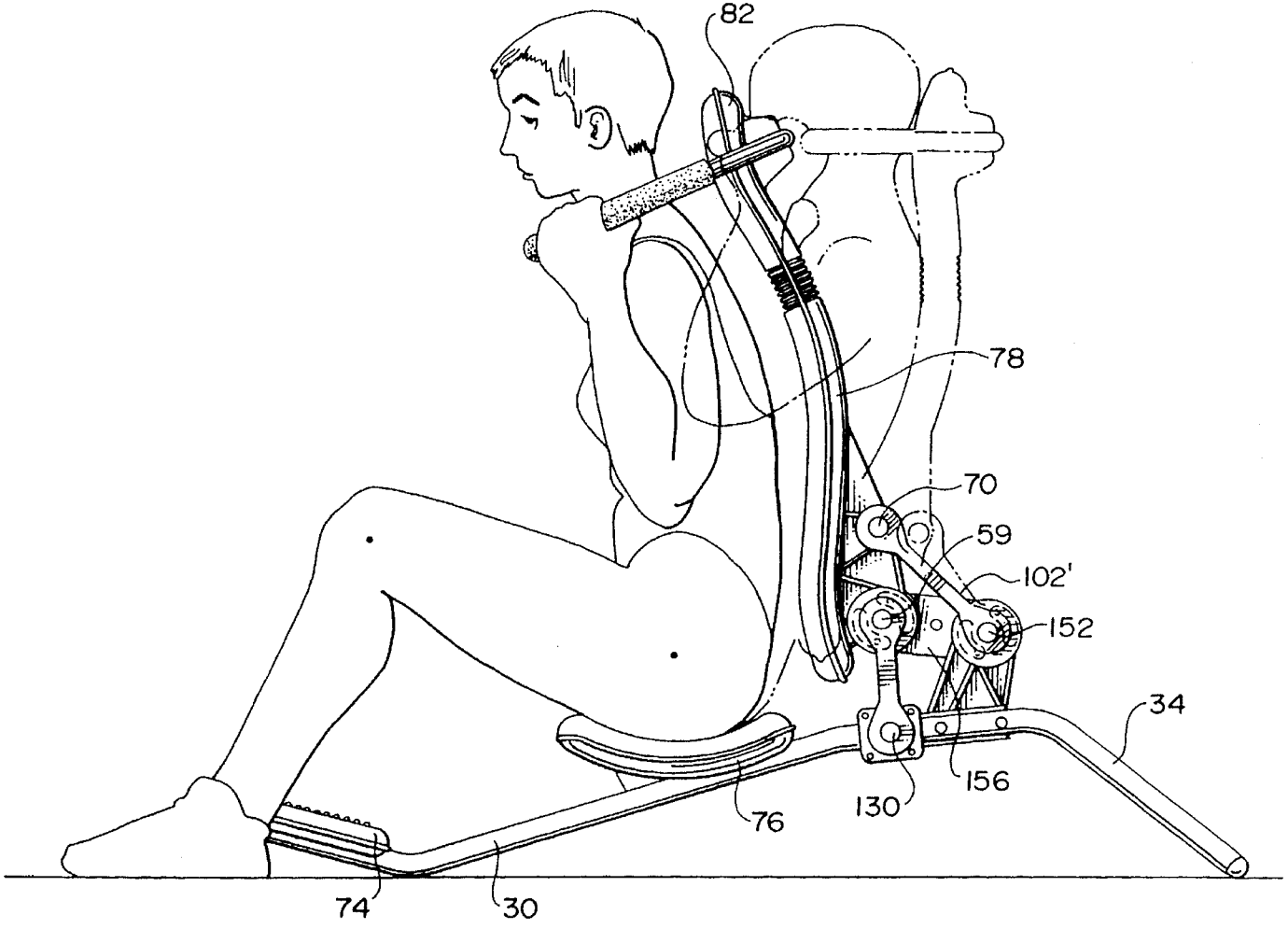
FIG. 12 is a left side elevational view illustrating the mechanical and biomechanical function of a retractive or compressive physical exercise of a second group of muscles, with the generally central, neutral position depicted in phantom dashed lines.

FIGS. 10–12 depict the use of the exercise device 20 of the present invention. FIG. 10 depicts the neutral, initial position a user is in before exercising or between repetitions of exercise movements. In FIG. 12, wherein the neutral position is shown in phantom, and wherein the user's feet are on the ground in an alternative exercise position (with respect to the foot-on-footrest position), the user has initially bent forward at the waist, moving the top of the back rest 78 generally toward the foot rest 74, thereby "crunching" the abdominal muscles. This movement is accomplished by moving the top 82 of the back rest 78 forward, along or about the axis of rotation provided by the axle 59 against the resistance provided by the members 102'. It should be appreciated that the stop openings 146, 148 adjacent to the axis of rotation about axle 152 are at their limit of travel, i.e., their ends are moved toward and are against the stop posts formed by the joined stop half posts 170, and that the arm 156 does not move. Relaxing the abdominal muscles returns the user to the neutral position, and returns the stop openings 62, 64 adjacent to the axle 59 to or adjacent to the limit of their range of travel.

For doing leg presses to exercise the back, gluteus and quadricep muscles, again the user starts from the neutral position (depicted in FIG. 10), and uses the back, gluteus and quadricep muscles to move the top 82 of the back rest 78 away from the foot rest 74, thereby raising the buttocks from the seat 76, arcing or arching the body as shown in FIG. 11. During this movement, the stop openings 62, 64 adjacent to the axle 59 are locked against the stops inside the arm 156, and the free end of the arm 156 (i.e., the end adjacent to the axle 59) and axis of rotation at the free end of the arm 156 move upwardly and rearwardly as far as the user wants, but not farther than the range of motion permitted by the internal stop posts (formed by the stop half posts 170) and stop openings 146, 148 adjacent to the axle 152. Both the internal stop posts and stop openings 146, 148 adjacent to the axle 152 have a range of motion during this movement from an initial stop point or relationship to a final stop relationship, wherein the back rest 78 is tipped backwardly into the generally horizontal position depicted in FIG. 11. The user then relaxes and returns to the neutral position. Either exercise movement may be done selectively, alternatively and/or repetitively until the desired level of workout is achieved.

Figure 14:
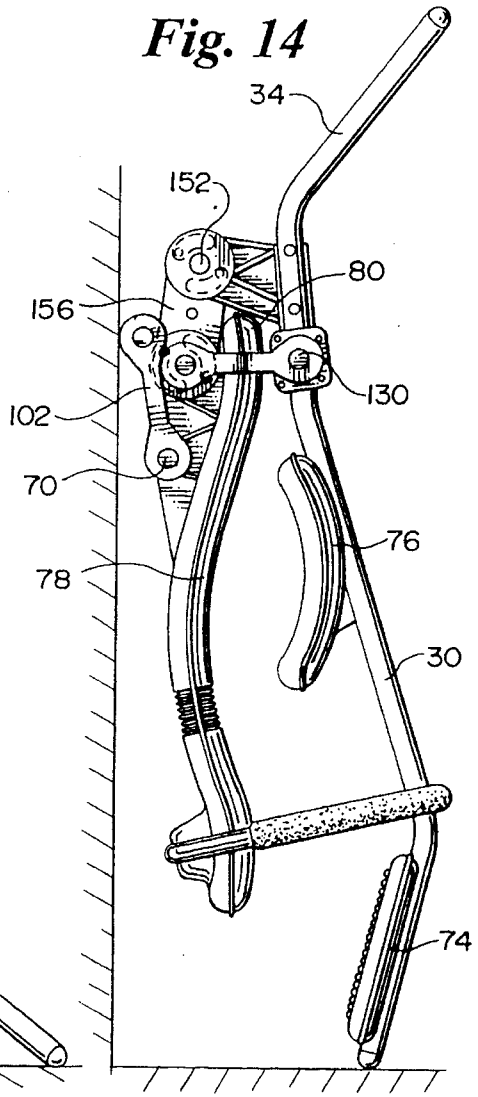
FIG. 14 is a left side elevational view of the present invention depicting an alternative vertical leaning storage position.
Figure 13:
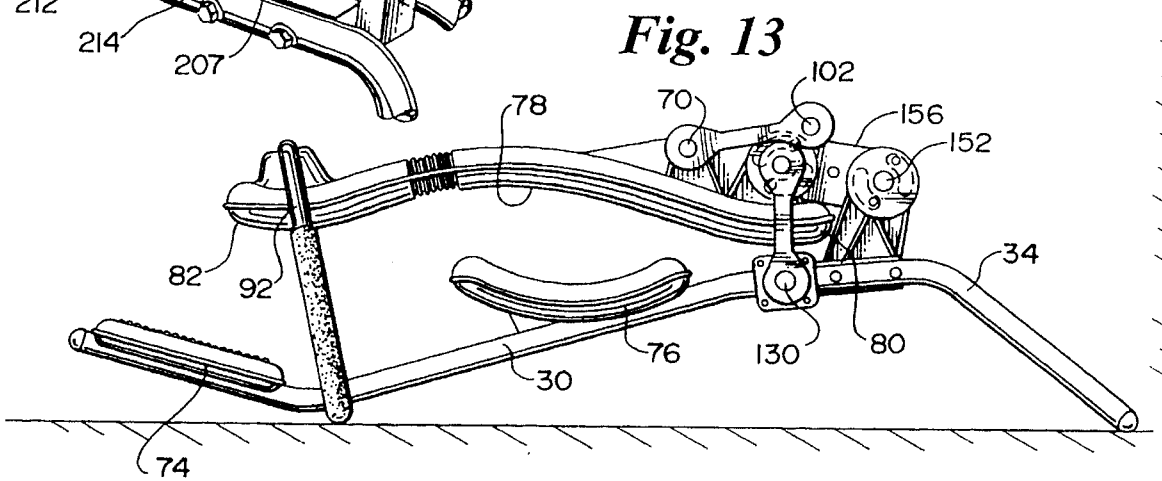
FIG. 13 is left side elevational view of the exercise device of the present invention depicting its folded storage floor position.

FIGS. 13 and 14 depict two stored positions of the exercise device 20 of the present invention. The elastomeric members 102 are detached from the axle 152, and the back rest 78 is folded forwardly until it is closely adjacent to the seat 76 with the tail end 80 tucked under the arm 156. The device 20 may be simply folded and left in place (FIG. 13) or it may be turned on end and stored vertically (FIG. 14).

The exercise device 20 may be changed or modified, as long as the ergonomic aspects of the device 20 are not impaired, by changing the support subframe 28, i.e., the legs, to have more acute angles or be more softly curved. The body support members (foot rest 74, seat 76 and back rest 78) may be positioned or shaped differently, again as long as the overall beneficial ergonomic effect of the device 20 is not diminished. For example, a single, generally continuous elongated body support member (not shown) may be substituted for the foot rest 74 and seat 76, and the body support members may be adjustably or movably coupled to the frame, e.g., the foot rest 74 or seat 76 may be tiltably adjustable. The arrangement of the elastomeric members 102 with respect to the pins 70, 130 and axles 59, 152 may be changed, as long as appropriate resistance to motion is provided. Additionally, torsion disks or a friction breaking system using pads or a pad and disk arrangement could be substituted for or used in conjunction with the elastomeric members 102. Non-slip "feet" may be carried by the subframe 28. While the body support members and at least a substantial portion of the joint 26 are formed of molded plastic, other materials and methods may be used to fabricate them.

Although a description of a preferred embodiment has been presented, various changes, including those mentioned above, could be made without deviating from the spirit of the present invention. It is desired, therefore, that reference be made to the appended claims rather than to the foregoing description to indicate the scope of the invention.

What is claimed is:

1. An exercise device for exercising at least two groups of muscles, said device comprising:

a frame including a generally tubular support subframe having two ends, said support subframe contacting a support surface adjacent to one end and at the second end, said support subframe generally arcuate and including a location farthest from the support surface generally between the ends, and a movable subframe operably coupled to the support subframe adjacent to said location and movable with respect to the support subframe;

a first body support member carried by the support subframe adjacent to said one end, a second body support member carried by the support subframe generally between said location and the one end, and a third body support member carried by the movable subframe, said first, second and third body support members positionally related to accommodate an exerciser in a sitting position with the exerciser's feet contacting the first body support member, the exerciser's buttocks contacting the second body support member and the exerciser's back generally contacting and resting against at least a portion of the third body support member; and a double joint coupling the support and movable subframes including a movable arm with two ends, one end coupled to the support subframe generally at said location, the other end coupled to the movable subframe.

2. The exercise device according to claim 1, further comprising a joint base mounted on the support subframe generally at said location and a receiver carried on the movable subframe.

3. The exercise device according to claim 2, wherein said arm has a generally central longitudinal axis and comprises two links joined at a plane containing the longitudinal axis.

4. The exercise device according to claim 3, further comprising adjustment means operably coupled to the joint for changing an amount of force required to move the movable subframe.

5. The exercise device according to claim 4, wherein said adjustment means comprises elastomeric tension members.

* * * * *